United States Patent [19]

Kemmler

[11] 4,074,701

[45] Feb. 21, 1978

[54] FLUIDIC SWITCH

[75] Inventor: Lothar Kemmler, Morfelden, Germany

[73] Assignee: Samson AG, Frankfurt, Germany

[21] Appl. No.: 703,609

[22] Filed: July 8, 1976

[30] Foreign Application Priority Data

July 8, 1975 Germany ..... 2530362

[51] Int. Cl.[2] ..... F15C 3/04

[52] U.S. Cl. ..... 137/625.66; 137/625.27; 137/625.5; 251/61.1

[58] Field of Search ..... 137/625.27, 85, 625.66, 137/625.5; 251/61.1; 92/99, 98

[56] References Cited

U.S. PATENT DOCUMENTS

| | | | |
|---|---|---|---|
| 3,590,694 | 7/1971 | Prescott | 137/85 X |
| 3,613,518 | 10/1971 | Prosser | 92/99 X |

FOREIGN PATENT DOCUMENTS

| | | | |
|---|---|---|---|
| 1,301,724 | 8/1969 | Germany | 251/61 |
| 1,303,304 | 12/1973 | Germany | 251/61 |
| 461,857 | 2/1937 | United Kingdom | 92/103 F |

*Primary Examiner*—Alan Cohan

[57] ABSTRACT

Fluidic switch with a switch housing having two housing halves and two actuating chambers separated by an actuating membrane having at its circumferential margin a sealing bolster substantially parallel to the plane of separation of the housing halves; a switch valve chamber; and an actuating lever extending from the actuating membrane into the switch valve chamber, fulcrumed about an axis parallel to the plane of separation on a resilient lead-through portion which is formed by a section of the sealing bolster.

7 Claims, 5 Drawing Figures

FLUIDIC SWITCH

BACKGROUND OF THE INVENTION

The invention relates to a fluidic switch for apparatus for measurement, regulation or control, which is comprised of the following: a switch housing consisting of two halves; two actuating chambers within the housing, into which chambers the actuating passages lead, the said chambers being separated by an actuating membrane having at its circumferential margin a sealing bolster substantially parallel to the plane of separation of the housing halves; a switch valve chamber having fluid inlets and outlets; and an actuating lever extending from the actuating membrane into the switch valve chamber, constructed as a plate valve body at the end of the membrane which extends into said switch valve chamber, and fulcrumed about an axis parallel to the plane of separation on a fulcrum bushing in the form of a resilient elastomeric crosspiece made integrally with the actuating lever and separating the actuating chamber from the switch valve chamber, the said crosspiece being clamped within internal transverse grooves provided in the housing halves parallel to the plane of separation.

Such switches, as they have become known through German "Auslegeschrift" 1,303,304, are required in large numbers for apparatus and systems for the performance of logic operations and elementary circuits, for example, it being fundamentally possible, of course, to use liquids and other fluids instead of compressed air as the controlling medium. For the application described above, switches of the kind in question must be of particularly simple construction and inexpensive to produce in mass production. In addition, the switches, for reasons of miniaturization, must occupy little space, must be east to install and remove, and nevertheless must be reliable in operation. Miniaturization is especially important in the production of pneumatic or hydraulic switching, controlling or regulating apparatus by means of bearing rails and conduit systems, such as those described in German Pat. No. 1,917,727, German "Offenlegungsschrift" 2,018,928, or German "Offenlegungsschrift" 2,146,041, which are hereby cited in full in this regard.

In the known switch described above, as it is described in German Auslegeschrift 1,303,304 or 1,301,724, and which has basically proven to be excellent, the actuating membrane is substantially circular in shape and is surrounded by an annular sealing bolster which, as a result of its compression between the two halves of the housing by means of appropriate fastening means, seals the two actuating chambers not only from one another but also from the outside. The actuating lever is embedded approximately centrally in the actuating membrane and from the edge of the embedded surface which stiffens the middle of the membrane, it departs from the plane of the membrane, and the sloping section of the lever leading away from the actuating membrane is adjoined by a long section parallel to the plane of separation, which outside of the annular sealing bolster surrounding the actuating membrane passes through a lead-through bushing consisting, like the membrane, of rubber or rubber-like material, the plate-like valve body being in turn disposed on the end of the actuating lever farthest from the actuating membrane, at a distance from the lead-through bushing, and being able, according to the pressure in the actuating chambers separated by the membrane, to be brought into engagement with the valve openings of two confronting fluid outlet passages, thereby providing a communication between either of the fluid passages and a central switching valve chamber.

Whereas in the known switch the sealing of the two actuating chambers from one another and from the outside by the annular sealing bolster is entirely satisfactory, the seal between the two actuating chambers on the one hand and the switching valve chamber containing the valve body at the end of the actuating lever on the other hand presents difficulties, inasmuch as the lead-through bushing is under constant compression producing sealing action only perpendicularly to the plane of separation of the housing, not in the direction of the fulcrum of the actuating lever, so that the danger exists that either control fluid or hydraulic pressure fluid leak laterally around the lead-through bushing. This results, in a highly undesirable manner, in interactions between the hydraulic pressure fluid and the control fluid system, which can greatly diminish the reliability of operation of the switch. Furthermore, it has been found that, due to the need for the spatial separation of the actuating membrane, the sealing bolster and the lead-through bushing, the known switch still is not small enough for a great number of applications.

THE INVENTION

The invention is addressed to the problem of creating a switch of the kind described above which, while requiring less space, will assure a more reliable seal between the actuating chambers and the switching valve chamber on the one hand and, on the other hand, a reliable seal against the outside.

This problem is solved in accordance with the invention, in a switch of the initially described kind, by making the lead-through bushing a section of the sealing bolster of the actuating membrane.

An especially preferred embodiment of the invention is characterized by a continuous, closed sealing bolster forming the margin of the membrane and encompassing the valve body section of the actuating lever with clearance, on that side of the lead-through bushing that is farthest from the membrane, and having a transverse, chord-like portion edging the membrane and constituting the lead-through bushing.

Additional particularly advantageous embodiments of the invention are specified in the subordinate claims.

The surprisingly simple and effective solution of the problem to which the invention is addressed is therefore successful in that, in a complete departure from the teaching of German "Auslegeschrift" 1,303,304, the actuating lever is no longer provided with a separate resilient lead-through bushing serving as a fulcrum, and instead the sealing bolster of the membrane itself is used as the fulcrum. In this manner, sealing surfaces perpendicular to the plane of separation of the housing are entirely eliminated, so that the compression maintained between the halves of the housing assures a reliable seal between the actuating chambers on the one hand and the switching valve chamber on the other by means of the annular bolster. Of course, the actuating chambers are also reliably sealed against the outside in this manner.

If the sealing bolster, as provided in the especially preferred embodiment described above, is continued beyond the chord-like portion forming the lead-through bushing and around the valve body of the actuating lever, a complete sealing of the switching valve chamber against the outside will additionally be achieved, in which case a single, integral component, namely the actuating membrane with the continuous sealing bolster formed thereon and its chord-like portion along with its valve body and actuating lever, not only completely solves all functional problems but also eliminates all sealing problems. And, inasmuch as both the lead-through bushing and the actuating lever are contained within the area circumscribed by the annular bolster of the actuating membrane, unlike the switch of German "Auslegeschrift" 1,303,304, a drastic reduction of the amount of space required by the switch of the invention is additionally achieved, such as is most highly desirable for miniaturization purposes.

DESCRIPTION OF A PREFERRED EMBODIMENT

In the following description an example of the embodiment of a pneumatically operated switch in accordance with the invention will be explained in detail with the aid of the diagrammatic drawing, wherein.

Figure 1:
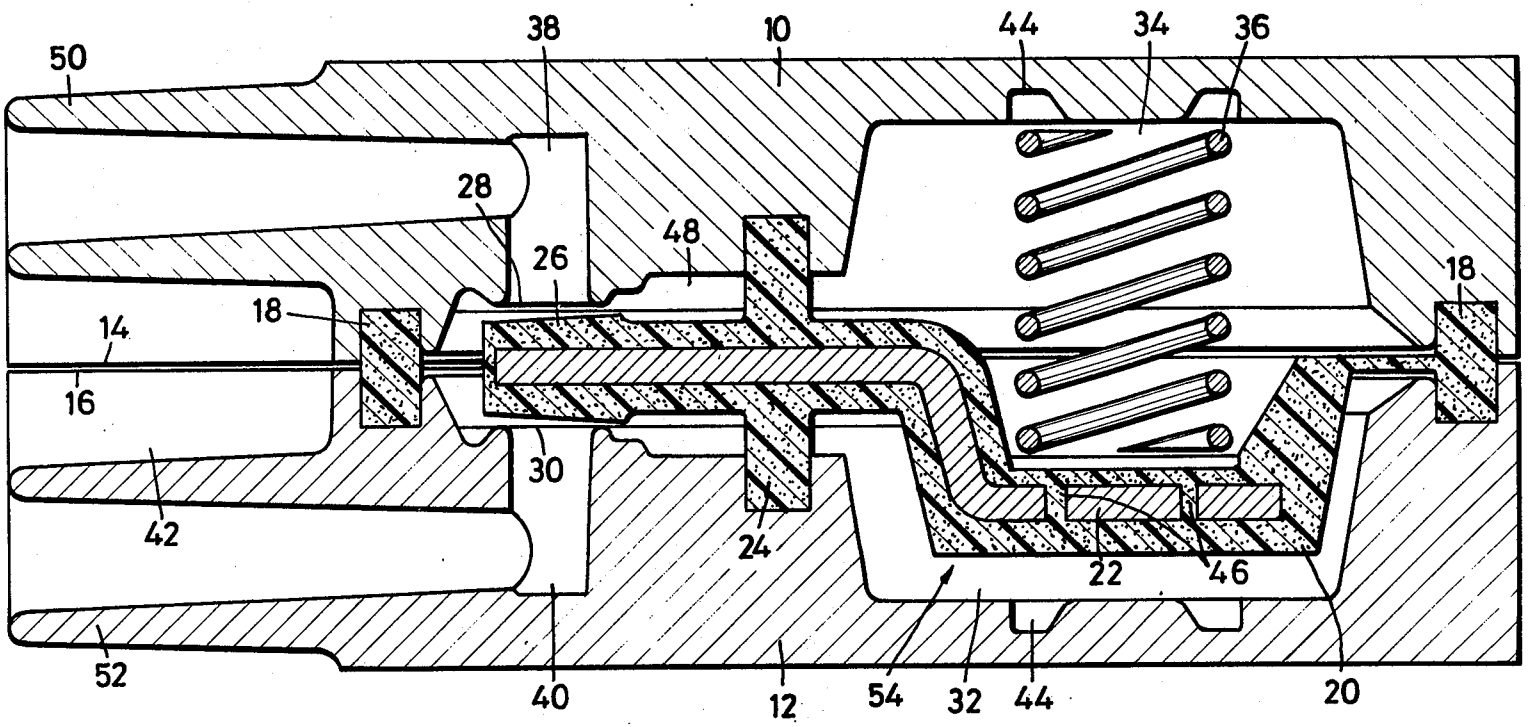
FIG. 1 is a longitudinal cross sectional view taken perpendicularly to the plane of separation of the housing halves and perpendicularly to the fulcrum axis of the actuating lever.

As shown in FIG. 1, the switch housing of the embodiment represented of a switch in accordance with the invention consists of two housing halves 10 and 12 whose plane of separation is perpendicular to the plane of the drawing. The housing halves 10 and 12, of shell-like construction, are provided with mating surfaces 14 and 16 and are held together by fastening means, such as screws or the like, which are not shown. Preferably the housing halves 10 and 12 are made of plastic, especially by the injection molding process; rivet pins and sockets to match them can be provided to facilitate the joining of the housing halves which together form the switch housing of the switch of the invention.

Between the housing halves 10 and 12, a continuous, closed sealing bolster 18 of an actuating membrane 20 made of synthetic rubber or the like is gripped in matching grooves formed in the said housing halves. In the manner which can be seen in the drawing, the actuating membrane 20 is of cup-like configuration and is integral with an actuating lever 22 extending from the cup portion shown on the right side of FIG. 1 through a chord-like section 24 consisting also of the elastomeric membrane material, and forms, at the extremity farthest from the cup portion, a valve body 26 which can be brought into sealing engagement with valve ports 28 and 30.

The cup portion of the actuating membrane separates, in the manner which can be seen in FIG. 1, the two actuating chambers 32 and 34 to which a fluid actuating medium, such as compressed air, can be delivered through inlets and from which it can be discharged through outlets, which are not shown. The actuating chamber 34 has a compression spring 36 which normally, without the application of an actuating pressure in one of chambers 32 or 34, urges the membrane, as seen in FIG. 1, downwardly, whereby the actuating lever 22 is pivoted on the fulcrum axis perpendicular to the plane of the drawing within the bushing 24 such that the valve body 26 closes the valve port 28 of a fluid passage 38. In this manner a fluid communication is assured, when the switch is in the inactive position, between a second fluid passage 40 and a fluid passage, which is not shown, which communicates with the switch valve chamber 48. If the actuating chamber 32 is filled with the actuating fluid under pressure, the actuating lever 22 will be raised against the bias of spring 36 to a position in which fluid passage 40 is closed and a fluid communication is provided between the fluid passage 38 and the fluid passage associated with the switch valve chamber 48.

As furthermore shown in FIG. 1, the compression spring 36 is situated in an annular groove 44 in housing half 10, although housing half 12, in the embodiment represented, also is provided with an identical annular groove 44. The latter, however, has no function, and serves only to enable the switch of the invention to be used in case of necessity as a negator merely by installing the actuating membrane 20 with actuating lever 22 (the latter having the bores 46, as shown in FIG. 1, which are filled with the membrane material) in the inverted position in the switch housing.

The housing halves 10 and 12 are of complementary construction and have the necessary grooves, sealing surfaces etc., for gripping membrane 20 by its sealing bolster 18 and the cross member 24 forming the lead-through bushing, and for the formation of the actuating chambers 32 and 34 and the switch valve chamber 48 accommodating the valve body 26, the valve seats 28 and 30 also being preformed in said housing halves. At the left end of the switch housing formed by housing halves 10 and 12, as seen in FIG. 1, nipples 50 and 52 are formed, which constitute the connections for the fluidic passages and the actuating inputs, a total of five nipples being therefore provided. These nipples are arranged so that they permit the swtich of the invention to be placed on a supporting rail provided with corresponding fluiding and actuating passages, as described, for example, in German "Offenlegungsschriften" 1,917,727, 2,0818,98 or 2,146,041, which are hereby cited in full in this regard.

Preferably, the material of the actuating membrane 20, that is, for example, the rubber composition, synthetic elastomer, or the like which can be vulcanized onto the actuating lever 22, and the material of the housing halves 10 and 12 are adapted to one another such that the housing halves can be joined together efficiently by means of radio-frequency or ultrasonic welding. To this end it is desirable that the synthetic composition of which the housing halves are formed have a higher absorptivity for radio-frequency or ultrasonic energy than the membrane composition, so as to assure that, when the entire assembled switch system is subjected to such energy, first the rivet posts or the like will be greatly heated and will join together the housing halves 10 and 12 before the rest of the switch system is unduly heated.

Figure 2:
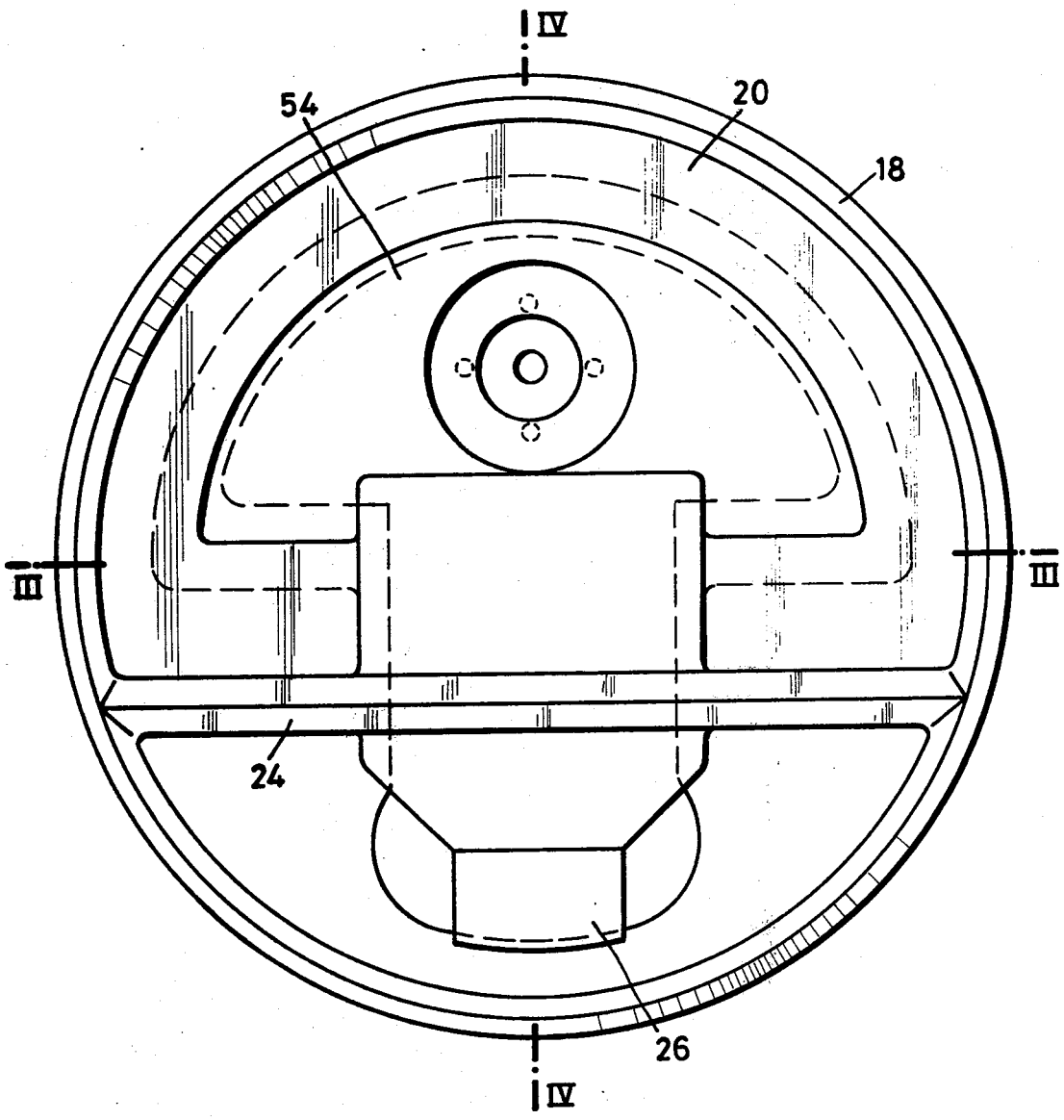
FIG. 2 is a top plan view of the sealing bolster, lead-through bushing and actuating lever of the switch represented in FIG. 1.
Figure 3:
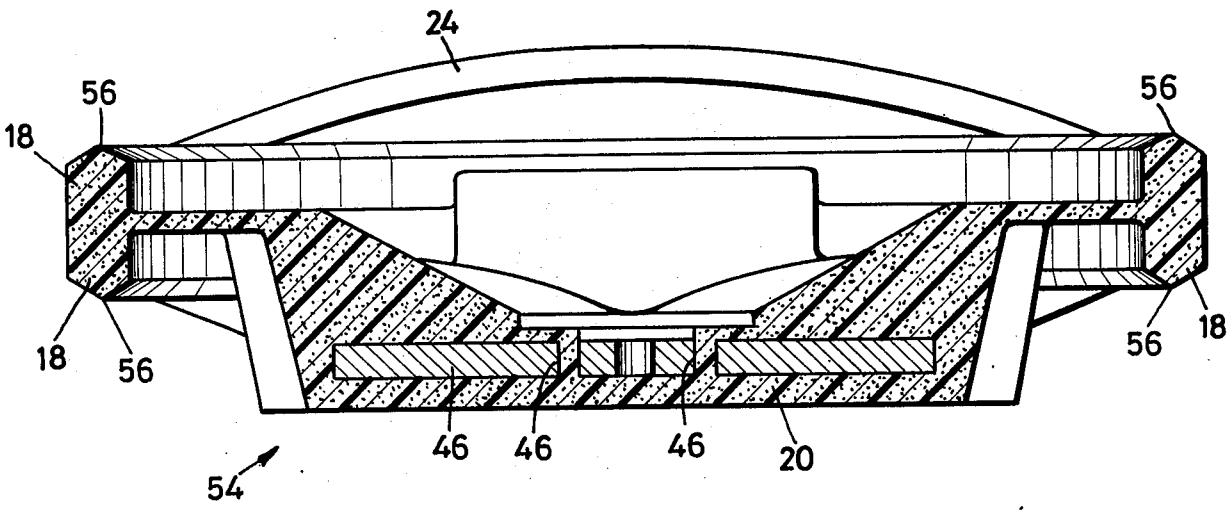
FIG. 3 is a cross sectional view of the actuating membrane shown in FIG. 2, taken along line III—III thereof.
Figure 4:
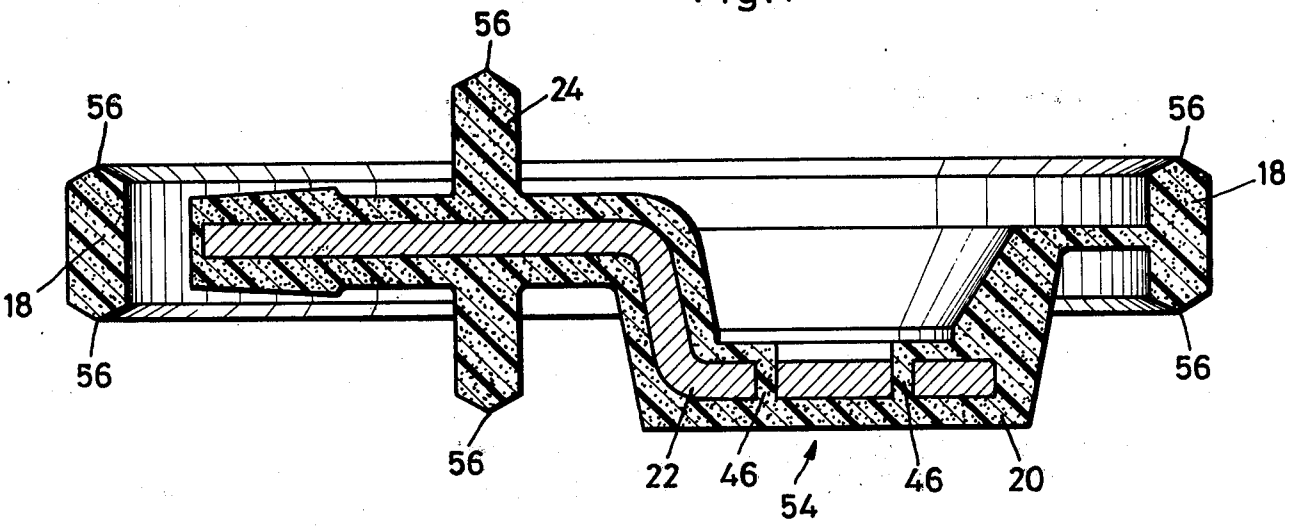
FIG. 4 is a longitudinal cross section of the actuating membrane represented in FIGS. 2 and 3, taken along line IV—IV of FIG. 2.

Essential to the invention is mainly the construction and shape of the actuating membrane 20 and of the parts formed integrally therewith--together, of course, with the corresponding construction of the housing halves 10 and 12 for the purpose of forming the necessary sealing surfaces, grooves, etc.--which can be seen especially in FIGS. 2 to 4. As it can be seen in FIG. 2, the actuating membrane 20 is provided with a circular sealing bead or bolster 18 having a chord-like cross member 24 bordering the cup portion 54 of the actuating membrane and serving as the resilient feed-through bushing, while the sealing bolster continues beyond the cross member 24 and surrounds, with clearance, the plate-like valve body 26 on that side of the cross member 24 that is opposite the cup portion 54 of actuating membrane 20.

Figure 5:
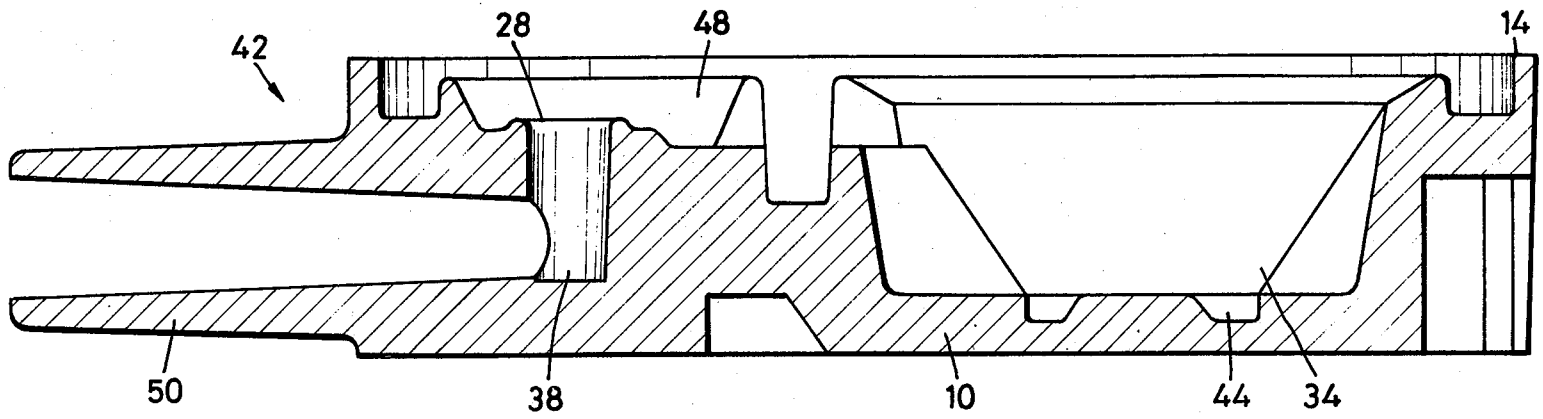
FIG. 5 is a longitudinal cross sectional view of one of the halves of the switch housing shown in FIG. 1, taken perpendicularly to the plane of separation of the housing halves and to the fulcrum axis of the actuating lever.

FIGS. 3 and 4 show that both the annular sealing bolster 18 and its chord-like cross member serving as the feed-through bushing have beveled sealing edges 56. These increase the elasticity of the membrane material in the corresponding grooves of the housing halves 10 and 12, which are illustrated in FIGS. 1 and 5, thereby permitting the compensation of greater production variations both in the membrane thickness and in the housing dimensions, without unduly increasing the forces perpendicular to the plane of separation of the housing halves which are required in order to hold them together. This is of great importance especially for the mass production of the switches of the invention.

FIG. 3 furthermore shows that the cross member 24, which forms the feed-through bushing and hence the fulcrum for the actuating lever 22 integral with membrane 20, is of an arcuate configuration. In the embodiment represented, this serves to provide room for the accommodation of the hydraulic fluid lines feeding the actuating chambers 34 and 32, but it is not essential to the embodiment of the concept of the invention, which is instead to be seen in the fact that, through the use of a portion of the sealing bolster 18 of the membrane 20 itself, namely the cross member 24, as a resilient bushing and fulcrum for the actuating lever 22, the problems which have hitherto existed in the sealing off of the switch valve chamber 48 from the actuating chambers 32 and 34 are completely eliminated. This is because the actuating chambers 32 and 34 are completely surrounded in the plane of separation of the housing halves 12 and 14 by the sealing bolster 18 and its cross member 24, so that forces acting perpendicularly to the plane of separation of the housing, by compressing the sealing edges 56 against the corresponding groove bottoms in the housing halves, permit the achievement of a perfect seal. Furthermore, the sealing bolster 18, by continuing on past the side of the cross member 24 farthest from the cup portion 54 of the actuating membrane and surrounding the valve boty 26 with clearance, assures a perfect sealing of the switch valve chamber 48 from the actuating chambers. Lastly, the integration of membrane 20, actuating lever 22, cross member 24 serving as fulcrum, and valve body 26 into an overall circular membrane structure surrounded by the annular sealing bolster 18, as proposed by the invention, brings with it a considerable saving of space whereby the switch of the invention can be made much smaller than the switches known hitherto. Since the assembly of the unit described above does not require additional steps, and in fact an integral assembly can be produced by injection molding, for example, the manufacture of the switch of the invention is extraordinarily simplified.

One of the housing halves 10 and 12 which are represented in FIG. 1 is shown in detail in FIG. 5. It is especially to be noted that the various transverse grooves in housing half 10 are made to comply precisely with the requirements of the membrane represented in FIGS. 2 to 4. Important also is the design of the valve seat at valve port 28, which is surrounded by a rounded raised portion which then descends to a flatter valve seat further out from the valve port. In this manner excessive compression of valve body 26 of actuating lever 22 is reliably prevented in the event of the application of too much pressure, without thereby impairing the sealing action and hence the reliability of the switching operation.

The features of the invention which have been set forth in the above description, in the drawing and in the following claims can be important both individually and in any desired combination for the realization of the invention in its various embodiments.

I claim:

1. Fluidic switch for measuring, regulating or controlling apparatus, comprising: a switch housing having two housing halves separated along a plane of separation and each provided with internal grooves parallel to said plane of separation, two actuating chambers provided in the switch housing, actuating passages leading into said chambers, an actuating membrane separating said chambers and having at its circumferential margin a sealing bolster substantially parallel to said plane of separation; a switch valve chamber having fluid inlets and outlets; and an actuating lever extending from the actuating membrane into the switch valve chamber, said lever forming a plate valve body at the end of the membrane which extends into said switch valve chamber, and being fulcrumed about an axis parallel to said plane of separation on a resilient bridge-like or plate-like lead-through portion sealingly separating the actuating chambers from the switch valve chambers, said body being integrated as a rubber body with the actuating lever and clamped within said grooves in the housing halves, said sealing bolster forming said membrane margin and surrounding with clearance said valve body section of said actuating lever at that end of the lead-through portion farthest from said membrane, said sealing bolster having a chord-wise disposed cross member bordering the membrane and forming said lead-through portion, said cross member being higher in a direction perpendicular to said plane of separation of the housing halves than said sealing bolster, and having in the plane normal to the plane of separation of the housing convexly curved upper and lower edges each facing one of the housing halves, the height of said cross member being greatest in the area of the longitudinal center of the cross member and coinciding with the height of the sealing bolster adjacent the ends of the cross member.

2. The switch of claim 1, wherein the sealing edges of sealing bolster facing the grooves in the housing halves have an outwardly diminishing cross section.

3. The switch of claim 2, wherein said sealing edges have a triangular cross section.

4. The switch of claim 1, wherein the actuating lever is completely embedded in the membrane.

5. The switch of claim 4, wherein the actuating lever has bores filled with the material of said membrane.

6. The switch of claim 1, wherein the membrane is of cup-like form, and a spring accommodated in said cup-like form for biasing the switch valve to a given switching position.

7. The switch of claim 1, wherein said switch housing is made of plastic.

* * * * *